US007563348B2

(12) United States Patent
Dordi et al.

(10) Patent No.: US 7,563,348 B2
(45) Date of Patent: Jul. 21, 2009

(54) ELECTROPLATING HEAD AND METHOD FOR OPERATING THE SAME

(75) Inventors: Yezdi Dordi, Palo Alto, CA (US); Bob Maraschin, Cupertino, CA (US); John Boyd, Atascadero, CA (US); Fred C. Redeker, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 389 days.

(21) Appl. No.: 10/879,396

(22) Filed: Jun. 28, 2004

(65) Prior Publication Data

US 2005/0284748 A1 Dec. 29, 2005

(51) Int. Cl.
*C25D 17/00* (2006.01)

(52) U.S. Cl. ..... 204/224 R; 204/225; 205/133

(58) Field of Classification Search ..... 204/224 R, 204/224 M; 205/118, 123, 133, 136
See application file for complete search history.

(56) References Cited

U.S. PATENT DOCUMENTS 3,963,588 A * 6/1976 Glenn ..... 205/96
5,660,642 A 8/1997 Britten
6,495,005 B1 12/2002 Colgan et al.
6,755,954 B2 * 6/2004 Mayer et al. ..... 205/96
6,773,559 B2 * 8/2004 Woodruff et al. ..... 204/222
2002/0121290 A1 9/2002 Tang et al.
2002/0125212 A1 9/2002 Mertens et al.
2002/0160698 A1 * 10/2002 Sato et al. ..... 451/67
2003/0127337 A1 * 7/2003 Hanson et al. ..... 205/96
2003/0141185 A1 * 7/2003 Wilson et al. ..... 204/227
2004/0016636 A1 * 1/2004 Yang et al. ..... 204/237

FOREIGN PATENT DOCUMENTS

JP 2001-024308 1/2001
JP 2001-049498 2/2001

* cited by examiner

*Primary Examiner*—Nam X Nguyen
*Assistant Examiner*—Luan V Van
(74) *Attorney, Agent, or Firm*—Martine Penilla & Gencarella, LLP

(57) ABSTRACT

An electroplating head including a chamber having a fluid entrance and a fluid exit is provided. The chamber is configured to contain a flow of electroplating solution from the fluid entrance to the fluid exit. The electroplating head also includes an anode disposed within the chamber. The anode is configured to be electrically connected to a power supply. The electroplating head further includes a porous resistive material disposed at the fluid exit such that the flow of electroplating solution is required to traverse through the porous resistive material.

16 Claims, 8 Drawing Sheets

ELECTROPLATING HEAD AND METHOD FOR OPERATING THE SAME

CROSS REFERENCE TO RELATED APPLICATIONS

This application is related to U.S. patent application Ser. No. 10/879,263, filed on even date herewith, and entitled "Method and Apparatus for Plating Semiconductor Wafers." The disclosure of this related application is incorporated herein by reference.

BACKGROUND OF THE INVENTION

1. Field of the Invention

The present invention relates to semiconductor fabrication.

2. Description of the Related Art

In the fabrication of semiconductor devices such as integrated circuits, memory cells, and the like, a series of manufacturing operations are performed to define features on semiconductor wafers. The semiconductor wafers include integrated circuit devices in the form of multi-level structures defined on a silicon substrate. At a substrate level, transistor devices with diffusion regions are formed. In subsequent levels, interconnect metallization lines are patterned and electrically connected to the transistor devices to define a desired integrated circuit device. Also, patterned conductive layers are insulated from other conductive layers by dielectric materials.

The series of manufacturing operations for defining features on the semiconductor wafers can include an electroplating process for adding material to the surface of the semiconductor wafer. Conventionally, electroplating is performed in a complete wafer electroplating processor with the entire wafer submerged in an electrolyte. During the conventional electroplating process, the wafer is maintained at a negative potential with respect to a positively charged anode plate, wherein the anode plate is substantially equal in size to the wafer. The anode plate is also submerged in the electrolyte and maintained in a position proximate to and parallel with the wafer.

During the plating process the wafer acts as a cathode. Thus, the wafer is required to be electrically connected to a number of electrodes. The number of electrodes are required to be uniformly distributed around a perimeter of the wafer and have substantially matched contact resistances in order to achieve a uniform current distribution across the wafer. In the complete wafer electroplating processor, a non-uniform current distribution across the wafer can result in a non-uniform plating thickness across the wafer.

While the conventional complete wafer electroplating processor is capable of depositing material on the surface of the wafer, there is an ever present need to continue researching and developing improvements in electroplating technology applicable to material deposition during semiconductor wafer fabrication.

SUMMARY OF THE INVENTION

In one embodiment, an electroplating head is disclosed. The electroplating head includes a chamber having a fluid entrance and a fluid exit. The chamber is configured to contain a flow of electroplating solution from the fluid entrance to the fluid exit. The electroplating head also includes an anode disposed within the chamber. The anode is configured to be electrically connected to a power supply. The electroplating head further includes a porous resistive material disposed at the fluid exit such that the flow of electroplating solution is required to traverse through the porous resistive material.

In one embodiment, an apparatus for electroplating a semiconductor wafer is disclosed. The apparatus includes a wafer support configured to hold a wafer. The apparatus also includes an electroplating head configured to be disposed over an upper surface of the wafer to be held by the wafer support. The electroplating head is configured to have a processing area defined to be substantially parallel with and proximate to an upper surface of the wafer. The processing area is defined by a long dimension that is at least equal to a diameter of the wafer and a short dimension that is less than the diameter of the wafer. The processing area is further defined as an exterior surface area of a porous resistive material. The apparatus further includes a first electrode disposed at a first location proximate to a first peripheral half of the wafer support. The first electrode is movably configured to electrically contact the wafer to be held by the wafer support. Additionally, the apparatus includes a second electrode disposed at a second location proximate to a second peripheral half of the wafer support that is exclusive of the first peripheral half of the wafer support. The second electrode is movably configured to electrically contact the wafer to be held by the wafer support. The electroplating head and the wafer support are configured to move with respect to one another in a direction extending between the first electrode and the second electrode, such that the electroplating head can traverse over an entirety of the upper surface of the wafer when the wafer is held by the wafer support.

In one embodiment, a method for operating an electroplating head is disclosed. The method includes an operation for disposing an electroplating head over and proximate to an upper surface of a wafer. The method also includes an operation for transferring cations from an anode to an electroplating solution within the electroplating head. In another operation of the method, the electroplating solution is flowed through a porous resistive material to exit the electroplating head and be disposed on the upper surface of the wafer. The method further includes an operation for establishing an electric current between the anode and the upper surface of the wafer through the electroplating solution. The electric current is uniformly distributed by the porous resistive material present between the anode and the upper surface of the wafer. Also, the electric current causes the cations to be attracted to the upper surface of the wafer.

Other aspects and advantages of the invention will become more apparent from the following detailed description, taken in conjunction with the accompanying drawings, illustrating by way of example the present invention.

BRIEF DESCRIPTION OF THE DRAWINGS

The invention, together with further advantages thereof, may best be understood by reference to the following description taken in conjunction with the accompanying drawings in which.

DETAILED DESCRIPTION

In the following description, numerous specific details are set forth in order to provide a thorough understanding of the present invention. It will be apparent, however, to one skilled in the art that the present invention may be practiced without some or all of these specific details. In other instances, well known process operations have not been described in detail in order not to unnecessarily obscure the present invention.

Figure 1:
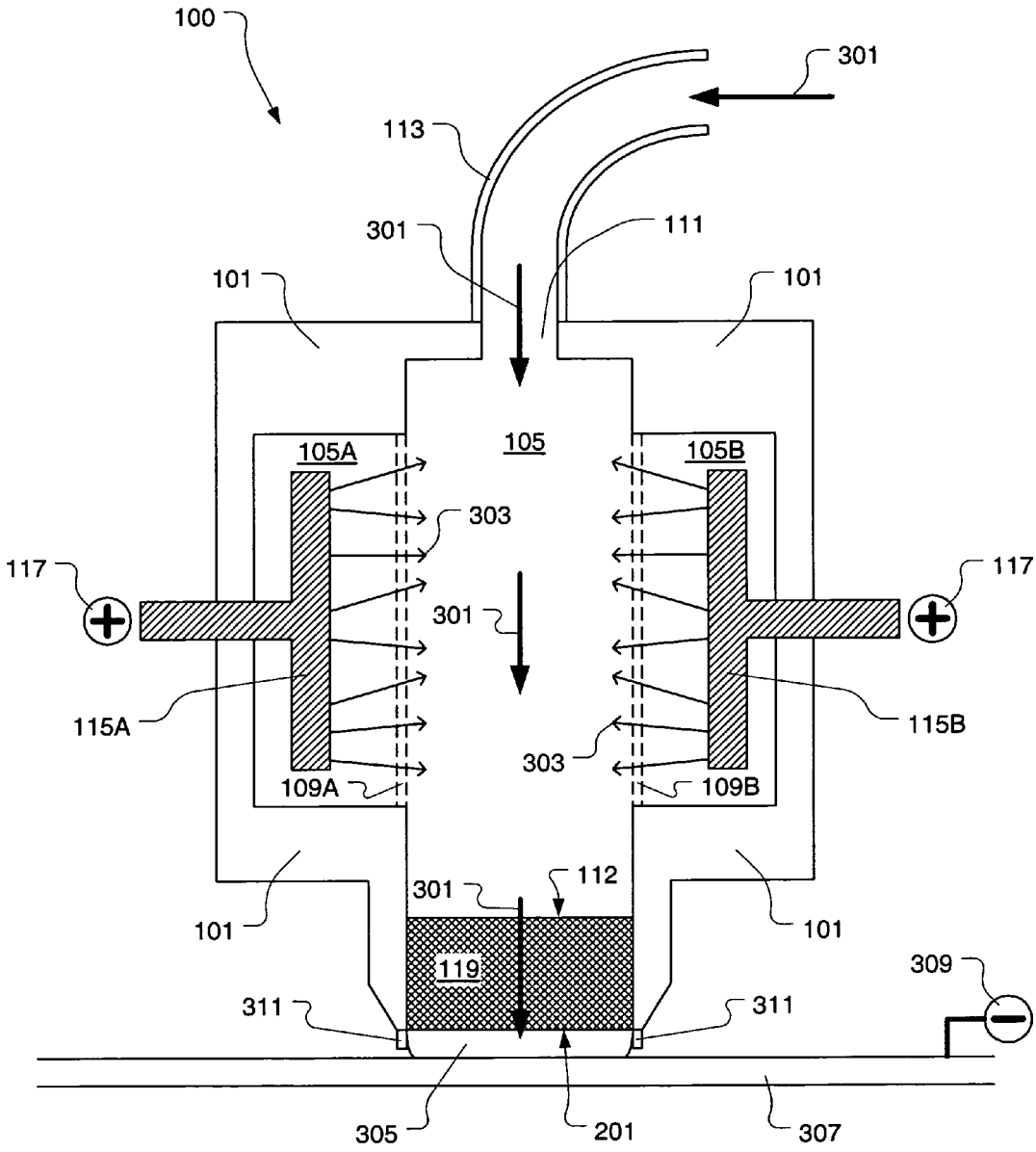
FIG. 1 is an illustration showing an electroplating head disposed over a wafer, in accordance with one embodiment of the present invention.

FIG. 1 is an illustration showing an electroplating head 100 disposed over a wafer 307, in accordance with one embodiment of the present invention. The electroplating head 100 includes a main chamber 105 formed within surrounding walls 101. It should be appreciated that the surrounding walls 101 can be defined in either an integral manner or as a combination of appropriately fastened and sealed components. The main chamber 105 includes a fluid entrance 111 and a fluid exit 112. A fluid supply 113 is attached to the fluid entrance 111 to supply electroplating solution to the main chamber 105. Thus, during operation the main chamber 105 is configured to contain a flow of electroplating solution from the fluid entrance 111 to the fluid exit 112, as indicated by arrows 301.

The electroplating head 100 also includes a first anode 115A and a second anode 115B disposed within anode chambers 105A and 105B, respectively. Each of the anodes 115A/115B is configured to be electrically connected to a power supply as indicated by a positive polarity 117. A shape and an orientation of each anode 115A/115B within its respective anode chamber 105A/105B can be defined in a number of different ways. Though the anodes 115A/115B and associated anode chambers 105A/105B can be configured in various ways within the electroplating head 100, it is desirable to establish the anodes 115A/115B and associated anode chambers 105A/105B in a manner that will provide a substantially uniform distribution of cations throughout the electroplating solution within the main chamber 105.

In one embodiment, the anodes 115A/115B are disposed with their respective anode chambers 105A/105B in a vertical orientation. The vertical orientation of the anodes 115A/115B enables natural circulation of an electroplating solution present within the respective anode chambers 105A/105B. The natural circulation can be induced by gravity acting upon particulate materials released from the anodes 115A/115B during the electroplating process. Also, it should be appreciated that the vertical orientation of the anodes 115A/115B corresponds to a perpendicular orientation of the anodes 115A/115B with respect to the wafer 307.

During the electroplating process, anode polarization can occur when solubility limits of dissolving ions cause precipitation of salts at the anode surface. The precipitated salts cause the anode to be insulated from the surrounding electroplating solution. The anode polarization effect is generally associated with exceeding a critical current flux during the electroplating process. As the precipitated salts proceed to insulate the anode, decreasing areas of uninsulated anode become responsible for providing an increased current flux. As the current flux increases at the uninsulated anode areas, a precipitate cascade results in a shut-down of reactions at the anode.

The vertical orientation of anodes within the anode chambers, as previously described, provides for mass transfer within anode chambers via natural convection, thus resulting in circulation of the electroplating solution within the anode chambers. The circulation of electroplating solution within the anode chambers prevents adhesion of precipitated salts to surfaces of the anode. It should be appreciated that the vertical orientation of each anode within its respective anode chamber, as provided by the present invention, avoids electroplating head design complexity, electroplating process complexity, and increased expense associated with having to mechanically circulate electroplating solution in order to reduce deposition of precipitated salts on the anode. Also, due to the reduction in salt deposition on the anode, the vertical orientation of each anode allows for an increase in a maximum allowable current flux.

While the embodiment of FIG. 1 shows the electroplating head 100 as including two anodes 115A/115B and associated anode chambers 105A/105B, it should be appreciated that in other embodiments the electroplating head 100 can include one or more anodes and associated anode chambers. Use of more anodes serves to increase current flux to the cathode, i.e., the wafer 307.

With respect to FIG. 1, each of the anode chambers 105A and 105B is configured to be filled with electroplating solution. However, the electroplating solution within each of the anode chambers 105A and 105B is separated from the main chamber 105 by a membrane 109A and 109B, respectively. For discussion purposes, the electroplating solution within the anode chambers 105A/105B is referred to as analyte. Also, the electroplating solution within the main chamber 105 is referred to as catalyte. In various embodiments, the analyte present within the anode chambers 105A/105B can be defined to have a chemistry that is either equivalent to or different from the chemistry of the catalyte present within the main chamber 105. Since the anode chambers 105A/105B are filled with analyte, there is essentially no air present in the anode chambers 105A/105B. Thus, the analyte within the anode chambers 105A/105B is rendered incompressible, thereby reducing a possibility that analyte will be transferred and mixed with catalyte present in the main chamber 105. Also, the incompressibility of the anode chambers 105A/105B allows a pressure within the main chamber 105 to be increased without causing distortion of the membranes 109A/109B.

During operation, each membrane 109A and 109B is defined to allow cations to pass from the anode chambers 105A and 105B, respectively, to the main chamber 105, as indicated by arrows 303. Also, the membranes 109A/109B are configured to prevent passage into the main chamber 105 of materials, e.g., particles and gases, from the anode chambers 105A/105B that could be detrimental to the electroplating process. In one embodiment, the membrane 109A/109B is defined by a fluorocarbon material. Also, in one embodiment, the membrane 109A/109B is defined to have a pore size, i.e., average pore diameter, within a range extending from about 0.2 micrometer to about 0.05 micrometer. The pore size of the membranes 109A/109B is sufficient to allow passage of cations from the anode chamber 105A/105B to the main chamber 105, without allowing passage from the anode chamber 105A/105B to the main chamber 105 of particulate materials generated by anodic reactions. Therefore, using the membranes 109A/109B to separate the analyte from the catalyte, as provided by the present invention, avoids problems associated with unwanted foreign particle transport from the anode to the wafer during the electroplating process.

In one embodiment, key organic additives are included within the catalyte to enhance the electroplating process performance at the cathode, i.e., wafer. In conventional electroplating systems where the anode and cathode interface directly with the same electroplating solution, these key organic additives are vulnerable to being consumed by the anode, thus reducing the additives available for the electroplating process at the cathode without replenishment of these additives. Consumption of the key organic additives by the anode is particularly problematic in the presence of copper (Cu) metal. The membranes 109A/109B of the present invention, however, serve to prevent these key organic additives present in the catalyte of the main chamber 105 from mixing with the analyte or being exposed to the copper electrodes in the anode chambers 105A/105B. Thus, due to the membranes 109A/109B, the key organic additives are not exposed to the anodes 115A/115B. Also, since the catalyte chemistry and the analyte chemistry can be separately controlled, a concentration of the key organic additives in the catalyte can be more closely controlled.

Further with respect to FIG. 1, the electroplating head 100 also includes a porous resistive material 119 disposed at the fluid exit 112. The catalyte within the main chamber 105 is required to traverse through the porous resistive material 119 in order to exit the electroplating head 100 at a processing area 201, as indicated by arrow 301. The processing area 201 is defined by a lower surface of the porous resistive material 119. During operation, the processing area 201 of the electroplating head 100 is positioned over, proximate to, and parallel with an upper surface of the wafer 307 to be processed. Cation laden electroplating solution, i.e., catalyte, exiting the electroplating head 100 at the processing area 201 forms a meniscus 305 between the processing area 201 and the upper surface of the wafer 307. Thus, the meniscus 305 essentially represents an electroplating reaction chamber defined by the processing area 201 of the electroplating head 100 and a distance between the processing area 201 and the wafer 307. In one embodiment, meniscus confinement surfaces 311 can be incorporated to assist in maintaining the meniscus within the region directly below the processing area 201. Essentially, the meniscus confinement surfaces 311 represent one or more surfaces that extend below the processing area 201 toward the wafer 307 at a periphery of the processing area 201. It should be understood, however, that the meniscus confinement surfaces 311 are not required for successful operation of the electroplating head 100.

During operation, a voltage potential is maintained between the anodes 115A/115B and the wafer 307, as indicated by a negative polarity 309. Thus, an electric current is established between the anodes 115A/115B and the wafer 307 via the electroplating solution (catalyte and analyte). The electric current causes metal ions (cations) produced at the anode to diffuse through the membranes 109A/109B to be carried by the catalyte through the porous resistive material 119 to the wafer 307 where plating occurs. The porous resistive material 119 serves to uniformly distribute the electric current established between the anodes 115A/115B and the wafer 307. Establishment of a more uniformly distributed electric current across the wafer 307 surface results in a more uniform material deposition. Thus, the porous resistive material 119 serves to provide a more uniform material deposition across the wafer surface.

In various embodiments, the porous resistive material 119 is defined as a porous ceramic, a porous glass, or a porous polymeric material. In one embodiment, the porous resistive material 119 is defined as aluminum oxide ($Al_2O_3$). In one embodiment, the porous resistive material 119 is defined to have a pore size, i.e., average pore diameter, within a range extending from about 30 micrometer to about 200 micrometers. It should be understood that the porous resistive material 119 of the present invention can be defined by any material capable of providing sufficient throughput of electroplating solution and sufficient pore/solid ratio to provide the required effective resistivity that yields electric current distribution uniformity.

Figure 2:
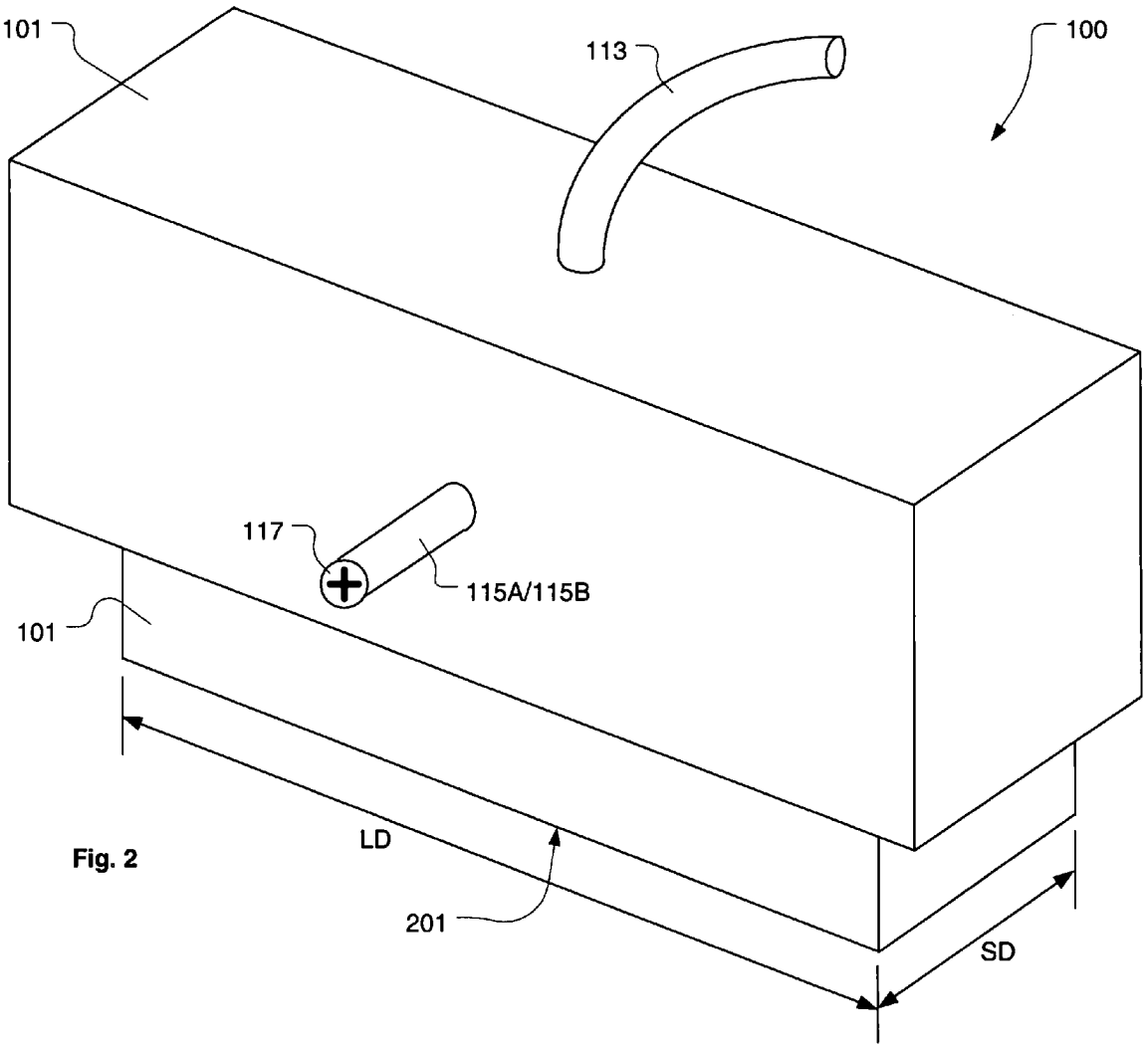
FIG. 2 is an illustration showing an isometric view of the electroplating head of FIG. 1, in accordance with one embodiment of the present invention.

FIG. 2 is an illustration showing an isometric view of the electroplating head 100 of FIG. 1, in accordance with one embodiment of the present invention. As previously discussed, the anode 115A, or 115B depending on perspective, is shown penetrating through the surrounding walls 101 to allow for electrical connection as indicated by the positive polarity 117. It should be appreciated that a variety of sealing mechanisms, e.g., rubber or plastic o-rings, metal compression seals, gaskets, etc., can be used to enable penetration of the anodes 115A/115B through the surrounding walls without leakage of analyte from within the associated anode chamber. Also, it should be appreciated that the anodes 115A/115B can be configured to penetrate through the surrounding walls 101 at essentially any location as necessary to interface with surrounding equipment and structure. Furthermore, the electroplating head 100 can be configured to allow connection of the fluid supply 113 at variable locations as necessary to interface with surrounding equipment and structure.

As previously mentioned, the processing area 201 is defined by the lower surface of the porous resistive material 119 disposed at the fluid exit 112 of the electroplating head 100. With respect to FIG. 2, the processing area 201 of the electroplating head 100 is defined by a long dimension LD and a short dimension SD. The long dimension LD is established to be at least equivalent to a diameter of a wafer to be processed. Conversely, the short dimension SD is established to be less than the diameter of the wafer to be processed. In one embodiment, the short dimension SD is substantially less than the diameter of the wafer to be processed. During operation, the processing area 201 of the electroplating head 100 is positioned over, proximate to, and parallel with the upper surface of the wafer. Also during operation, the electroplating head 100 and the wafer are controlled to move relative to each other such that the processing area 201 of the electroplating head 100 traverses over the upper surface of the wafer. As the processing area 201 traverses over the upper surface of the wafer, the electroplating head 100 is maintained in an orientation, with respect to the wafer, such that the long dimension LD is substantially perpendicular to a direction of movement between the processing area 201 and the wafer. Therefore, the processing area 201 and associated meniscus 305 are capable of being traversed over an entirety of the upper surface of the wafer during the electroplating operation.

Figure 3A:
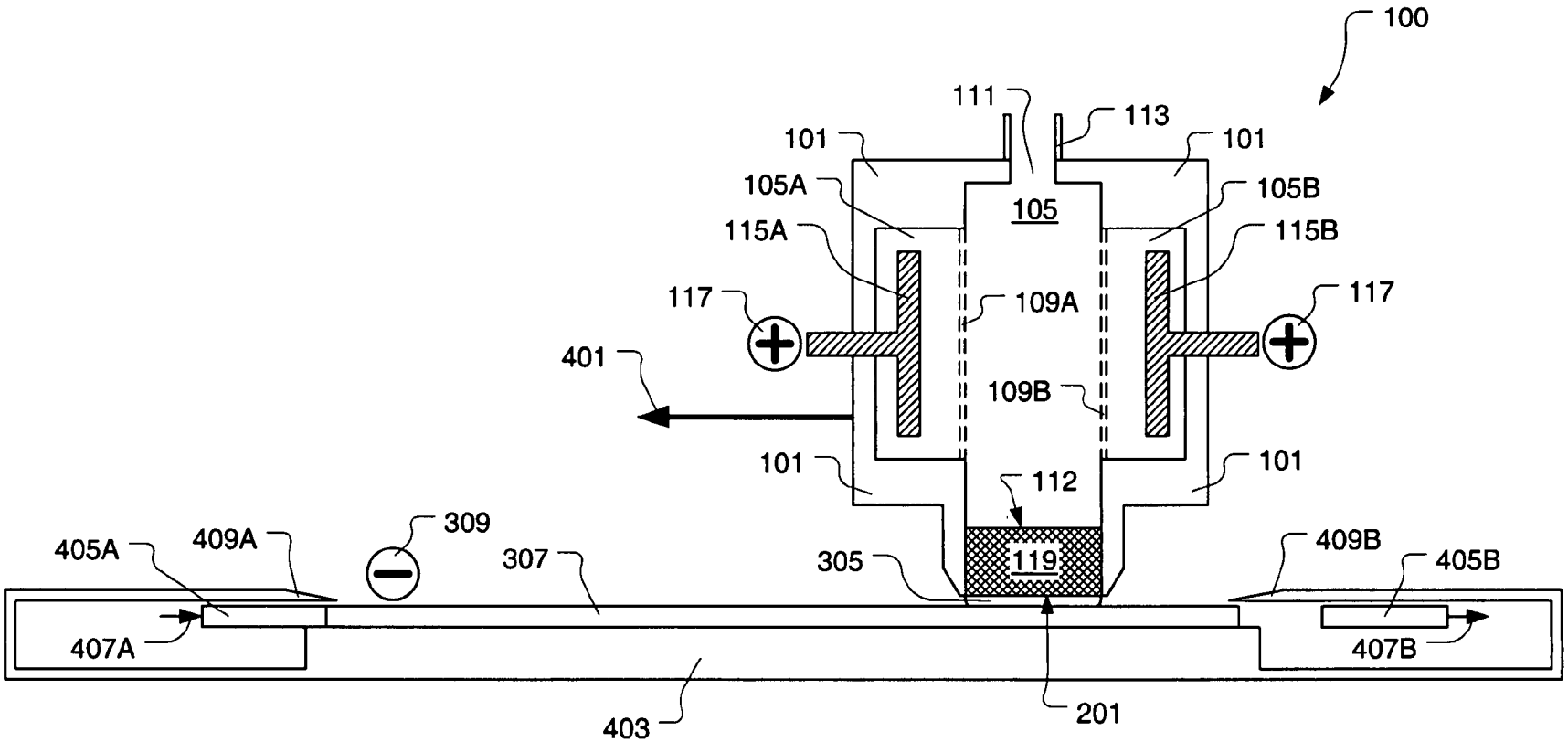
FIG. 3A is an illustration showing the electroplating head being applied in an electroplating process, in accordance with one embodiment of the present invention.

FIG. 3A is an illustration showing the electroplating head 100 being applied in an electroplating process, in accordance with one embodiment of the present invention. Each component of the electroplating head 100 is the same as previously described with respect to FIGS. 1 and 2. During the electroplating process, the electroplating head 100 is moved over the wafer 307 in a direction 401 such that the processing area 201 remains substantially parallel with and proximate to the upper surface of the wafer 307. Thus, as the electroplating head 100 is traversed over the wafer 307, the meniscus 305 is also traversed over the wafer. As previously discussed with respect to FIG. 2, the electroplating head 100 is configured such that the meniscus can be traversed over an entirety of the upper surface of the wafer during the electroplating operation.

During the electroplating process, the wafer 307 is held by a wafer support 403. Each of a first electrode 405A and a second electrode 405B is located proximate to a periphery of the wafer support 403. Additionally, the second electrode 405B is located at a position that is substantially opposite from the first electrode 405A relative to the wafer support 405. In one embodiment, the first electrode 405A is disposed at a first position near the periphery of the wafer support 403, such that the first position resides along a first peripheral half of the wafer support 403. Also, in the same embodiment, the second electrode 405B is disposed at a second position near the periphery of the wafer support 403, such that the second position resides along a second peripheral half of the wafer support 403 that is exclusive of the first peripheral half of the wafer support 403.

Each of the first electrode 405A and the second electrode 405B is configured to be moved to electrically connect to and disconnect from the wafer 307 as indicated by arrows 407A and 407B, respectively. It should be appreciated that the movement of the electrodes 405A and 405B to connect with and disconnect from the wafer 307 can be conducted in an essentially limitless number of ways. For example, in one embodiment, the electrodes 405A and 405B can be moved linearly in a plane aligned with the wafer. In another embodiment, the electrodes 405A and 405B having a sufficient elongated shape and being oriented in a coplanar arrangement with the wafer 307 can be moved in a rotational manner to contact the wafer. Also, it should be appreciated that the shape of the electrodes 405A and 405B can be defined in a number of different ways. For example, in one embodiment, the electrodes 405A and 405B can be substantially rectangular in shape. In another embodiment, the electrodes 405A and 405B can be rectangular in shape with the exception of a wafer contacting edge which can be defined to follow a curvature of the wafer periphery. In yet another embodiment, the electrodes 405A and 405B can be C-shaped. It should be understood, that the present invention requires at least two electrodes that can be independently manipulated to electrically connect with and disconnect from a wafer 307.

Also with respect to FIG. 3A, fluid shields 409A and 409B are provided to protect the first and second electrodes 405A and 405B, respectively, from exposure to the meniscus 305 of electroplating solution as the electroplating head 100 and meniscus 305 traverses thereabove. In one embodiment, each of the first and second electrodes 405A/405B is controllable to be moved away from the wafer 307 and retracted beneath its respective fluid shield 409A/409B, as the electroplating head 100 and meniscus 305 of electroplating solution traverses thereabove.

During the electroplating process, the anodes 115A/115B and at least one of the first and second electrodes 405A/405B are electrically connected to a power supply such that a voltage potential exist therebetween. With respect to FIG. 3A, the first electrode 405A is moved to be electrically connected to the wafer 307 such that the negative polarity 309 is established across the upper surface of the wafer 307. Thus, an electric current will flow through the electroplating solution (defined by the analyte, catalyte, and meniscus) between the anodes 115A/115B and the first electrode 405A. The electric current enables the electroplating reactions to occur at portions of the upper surface of the wafer 307 that are exposed to the meniscus 305. Hence, the portions of the upper surface of the wafer 307 that are exposed to the meniscus 305 serve as the cathode in the electroplating process.

The first electrode 405A remains connected to the wafer 307 as the electroplating head 100 traverses away from the second electrode 405B toward the first electrode 405A. In one embodiment, the second electrode 405B is maintained in the retracted position until the electroplating head 100 and meniscus 305 is a sufficient distance away from the second electrode 405B to ensure that the second electrode 405B is not exposed to electroplating solution.

Also, connection of the first electrode 405A and the second electrode 405B to the wafer 307 is managed to optimize a current distribution present at the portion of the upper surface of the wafer 307 that is in contact with the meniscus 305. In one embodiment, it is desirable to maintain a substantially uniform current distribution at an interface between the meniscus 305 and the wafer 307 as the electroplating head 100 traverses over the wafer 307. It should be appreciated, that maintaining the electroplating head 100 a sufficient distance away from the connected electrode allows the current distribution at the interface between the meniscus 305 and the wafer 307 to be more uniformly distributed. Thus, in one embodiment, transition from connection of the first electrode 405A to connection of the second electrode 405B occurs when the processing area 201 of the electroplating head 100 is substantially near a centerline of the upper surface of the wafer 307, wherein the centerline is oriented to be perpendicular to a traversal direction of the electroplating head 100.

During transition from connection of the first electrode 405A to connection of the second electrode 405B, the connection of the first electrode 405A to the wafer 307 is maintained until the second electrode 405B is connected. Once the second electrode 405B is connected to the wafer 307, the first electrode 405A is disconnected from the wafer 307. Maintaining at least one electrode connected to the wafer 307 serves to minimize a potential for gaps or deviations in material deposition produced by the electroplating process.

Figure 3B:
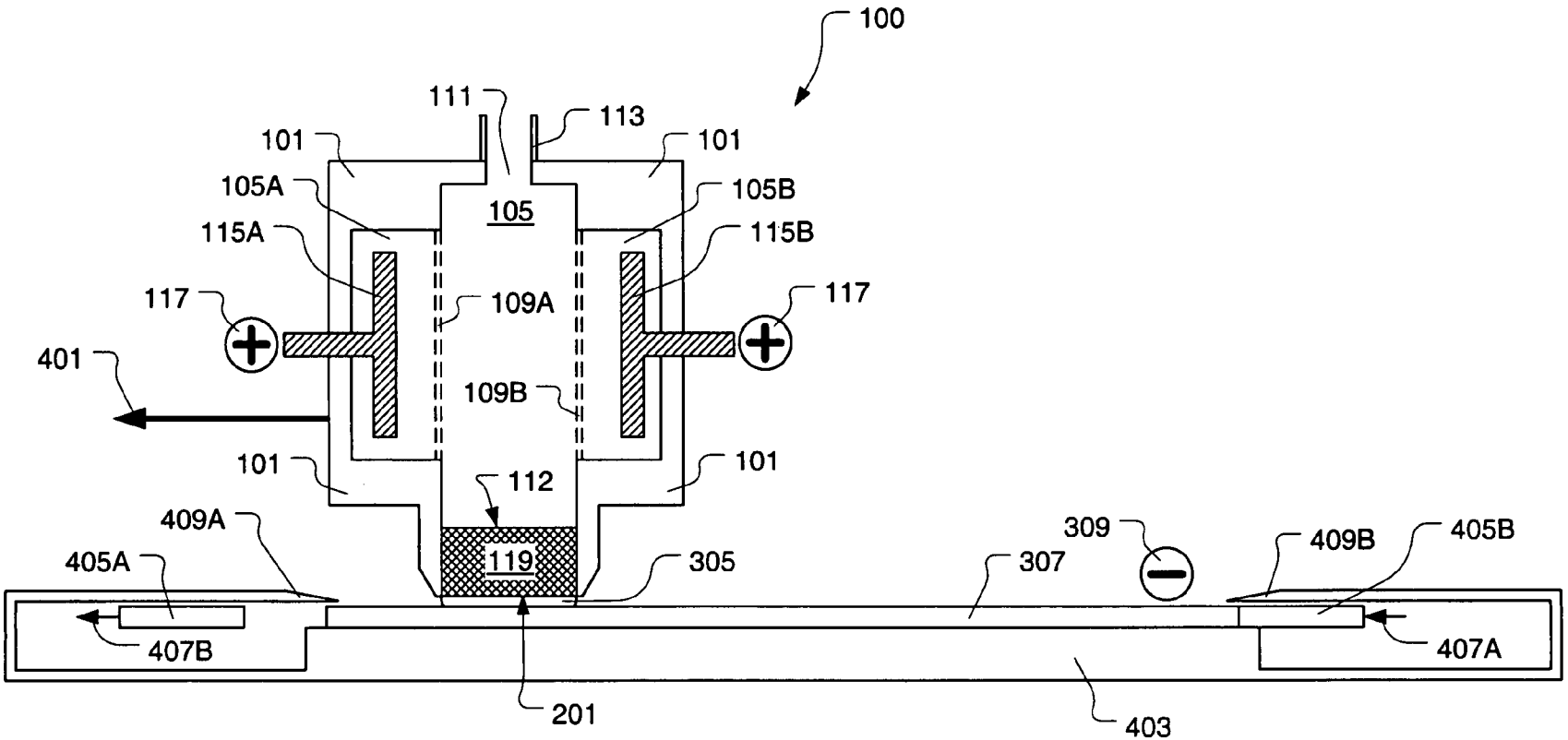
FIG. 3B is an illustration showing a continuation of the electroplating process depicted in FIG. 3A, in accordance with one embodiment of the present invention.

FIG. 3B is an illustration showing a continuation of the electroplating process depicted in FIG. 3A, in accordance with one embodiment of the present invention. FIG. 3B shows the first and second electrodes 405A/405B following transition from connection of the first electrode 405A to connection of the second electrode 405B. Also, FIG. 3B shows the electroplating head 100 continuing to traverse over the wafer 307 toward the first electrode 405A. The second electrode 405B is shown connected to the wafer 307. The first electrode 405A is shown disconnected from the wafer 307 and retracted beneath the fluid shield 409A to be sheltered from the approaching meniscus 305. Following the electrode transition, the electric current flows through the electroplating solution (defined by the analyte, catalyte, and meniscus) between the anodes 115A/115B and the second electrode 405B.

Figure 4A:
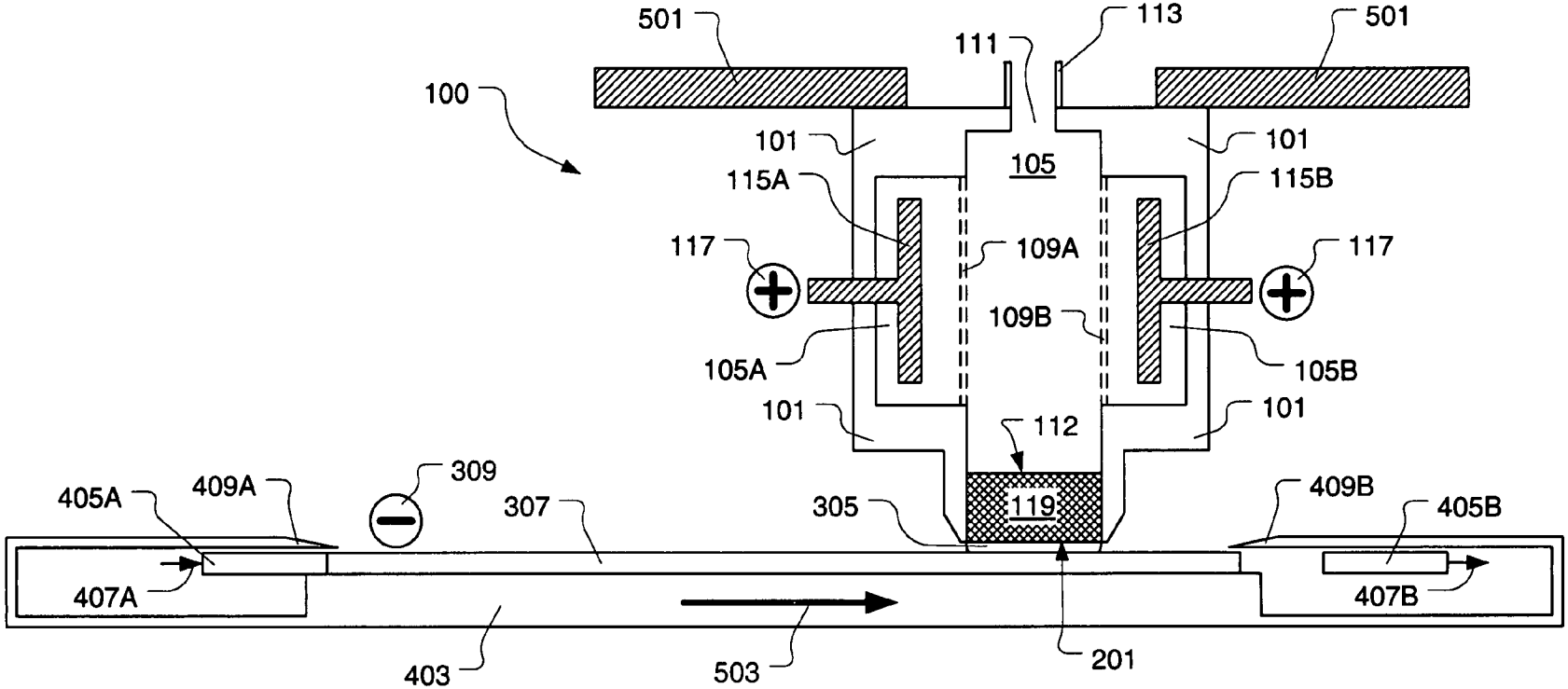
FIG. 4A is an illustration showing the electroplating head being applied in an electroplating process, in accordance with another embodiment of the present invention.

FIG. 4A is an illustration showing the electroplating head 100 being applied in an electroplating process, in accordance with another embodiment of the present invention. The arrangement depicted in FIG. 4A is equivalent to that of FIG. 3A with the exception that the wafer support 403, electrodes 405A/405B, and fluid shields 409A/409B are configured to be moved together in a linear direction 503, below the electroplating head 100 which is maintained in a fixed position secured to support structure 501. It should be understood that during operation of the apparatus of FIG. 4A, the processing area 201 of the electroplating head 100 is oriented in a manner similar to that previously discussed with respect to FIG. 3A. Also, the electrodes 405A/405B are controlled to electrically connect to and disconnect from the wafer 307 based on the processing area 201 and meniscus 305 location, as previously described with respect to FIGS. 3A and 3B. It should be appreciated that since the apparatus of FIG. 4A does not require movement of equipment above the wafer 307, it is conceivable that the apparatus of FIG. 4A will allow for easier prevention of unwanted foreign particle deposition on the upper surface of the wafer 307.

Figure 4B:
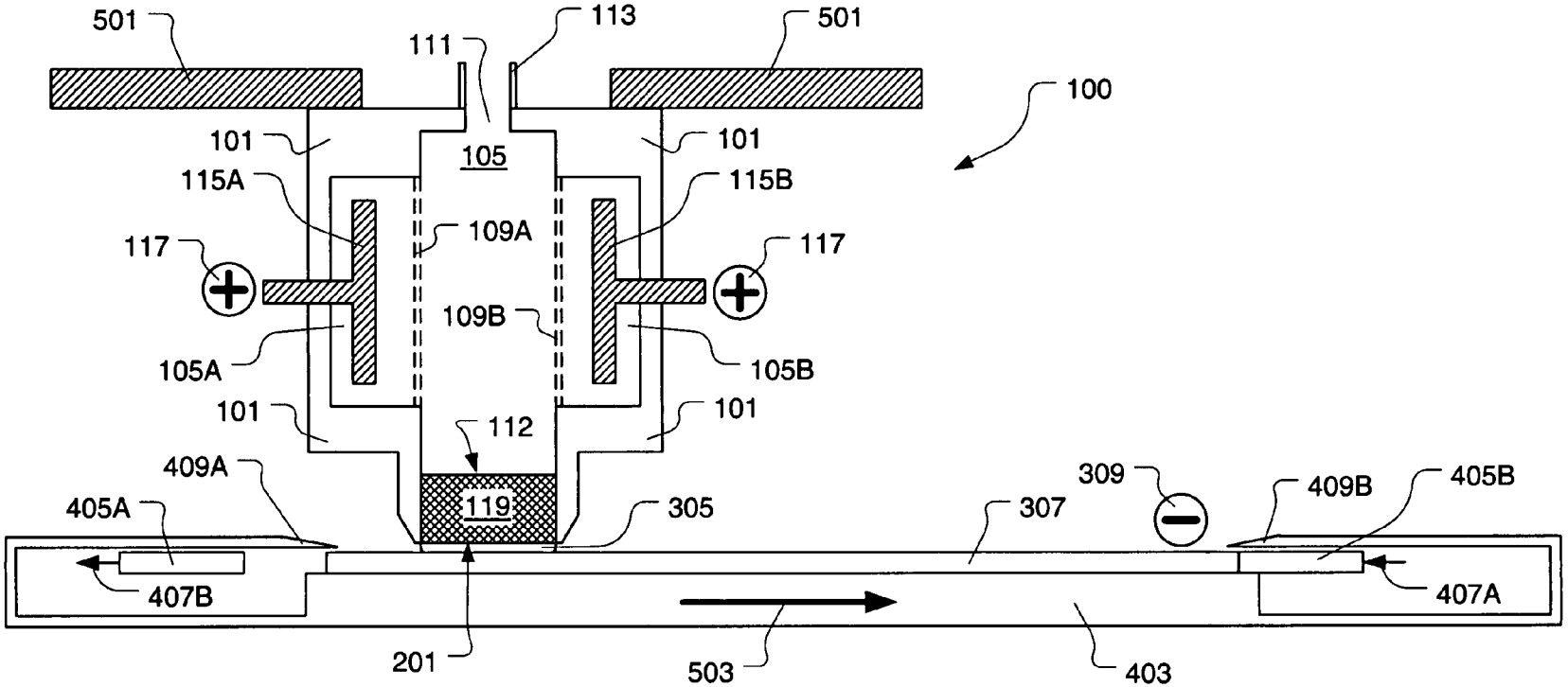
FIG. 4B is an illustration showing a continuation of the electroplating process depicted in FIG. 4A, in accordance with one embodiment of the present invention.

FIG. 4B is an illustration showing a continuation of the electroplating process depicted in FIG. 4A, in accordance with one embodiment of the present invention. FIG. 4B shows the first and second electrodes 405A/405B following transition from connection of the first electrode 405A to connection of the second electrode 405B. Also, FIG. 4B shows the wafer 307 continuing to be traversed beneath the electroplating head 100 such that the meniscus 305 continues to move toward the first electrode 405A. The second electrode 405B is shown connected to the wafer 307. The first electrode 405A is shown disconnected from the wafer 307 and retracted beneath the fluid shield 409A to be sheltered from the approaching meniscus 305.

Figure 5:
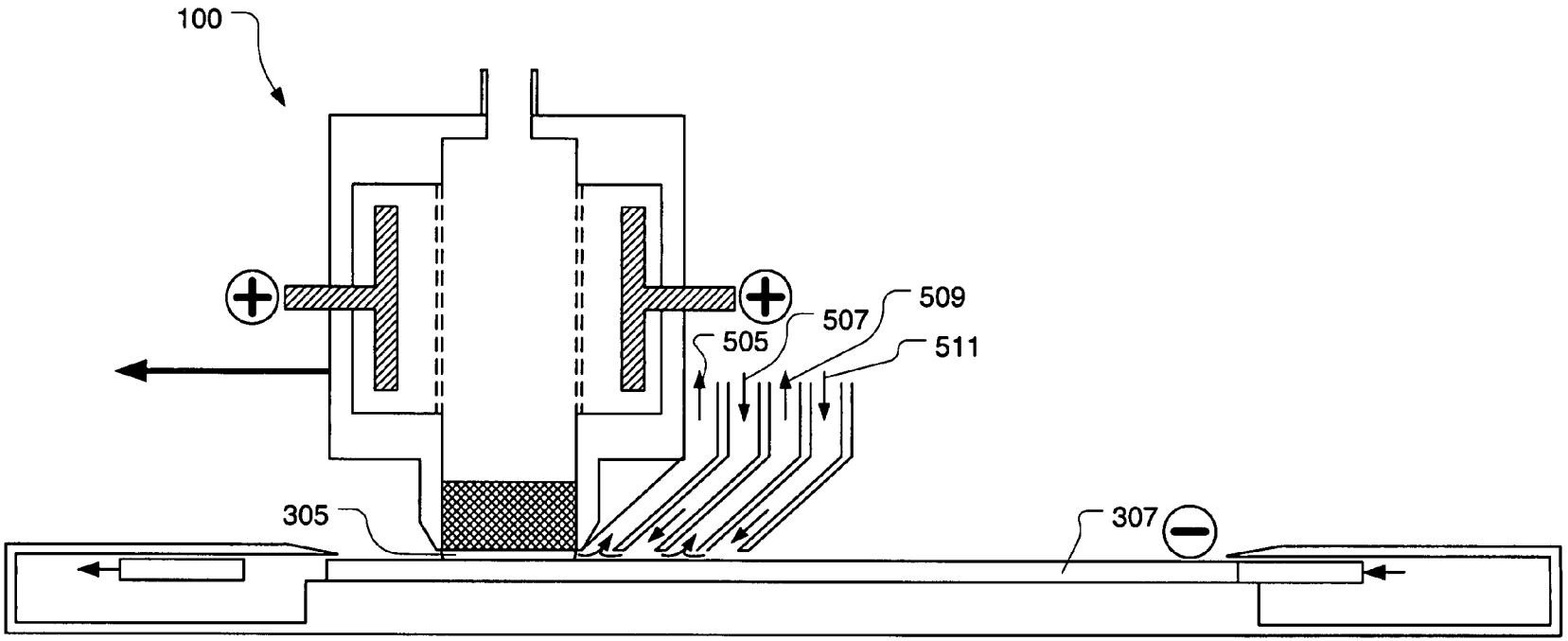
FIG. 5 is an illustration showing an arrangement of wafer surface conditioning devices configured to follow the electroplating head as it traverses over the wafer, in accordance with one embodiment of the present invention.

FIG. 5 is an illustration showing an arrangement of wafer surface conditioning devices configured to follow the electroplating head 100 as it traverses over the wafer 307, in accordance with one embodiment of the present invention. For discussion purposes, each wafer surface condition device is represented as a vent configured to apply or remove fluid from the upper surface of the wafer 307. Each vent is configured to have an adequately sized flow area to apply and remove fluids at a sufficient rate. It should be appreciated that each depicted vent can be connected to a variety of equipment, e.g., hoses, pumps, metrology, reservoirs, etc., capable of controlling fluid application and removal.

With respect to FIG. 5, a first vent 505 provides a vacuum to remove fluids from the surface of the wafer 307 following traversal of the meniscus 305 thereover. A second vent 507 applies a rinsing fluid to the surface of the wafer 307. In one embodiment, the rinsing fluid is deionized water. However, in other embodiments, any rinsing fluid suitable for use in wafer processing applications can be used. Similar to the first vent 505, a third vent 509 provides a vacuum to remove fluids from the surface of the wafer 307. A fourth vent 511 can be used to apply an isopropyl alcohol (IPA)/nitrogen mixture to the surface of the wafer 307. It should be appreciated that the present invention can be implemented using a portion of the vents described with respect to FIG. 5 or other wafer surface conditioning devices not explicitly described herein.

Figure 6:
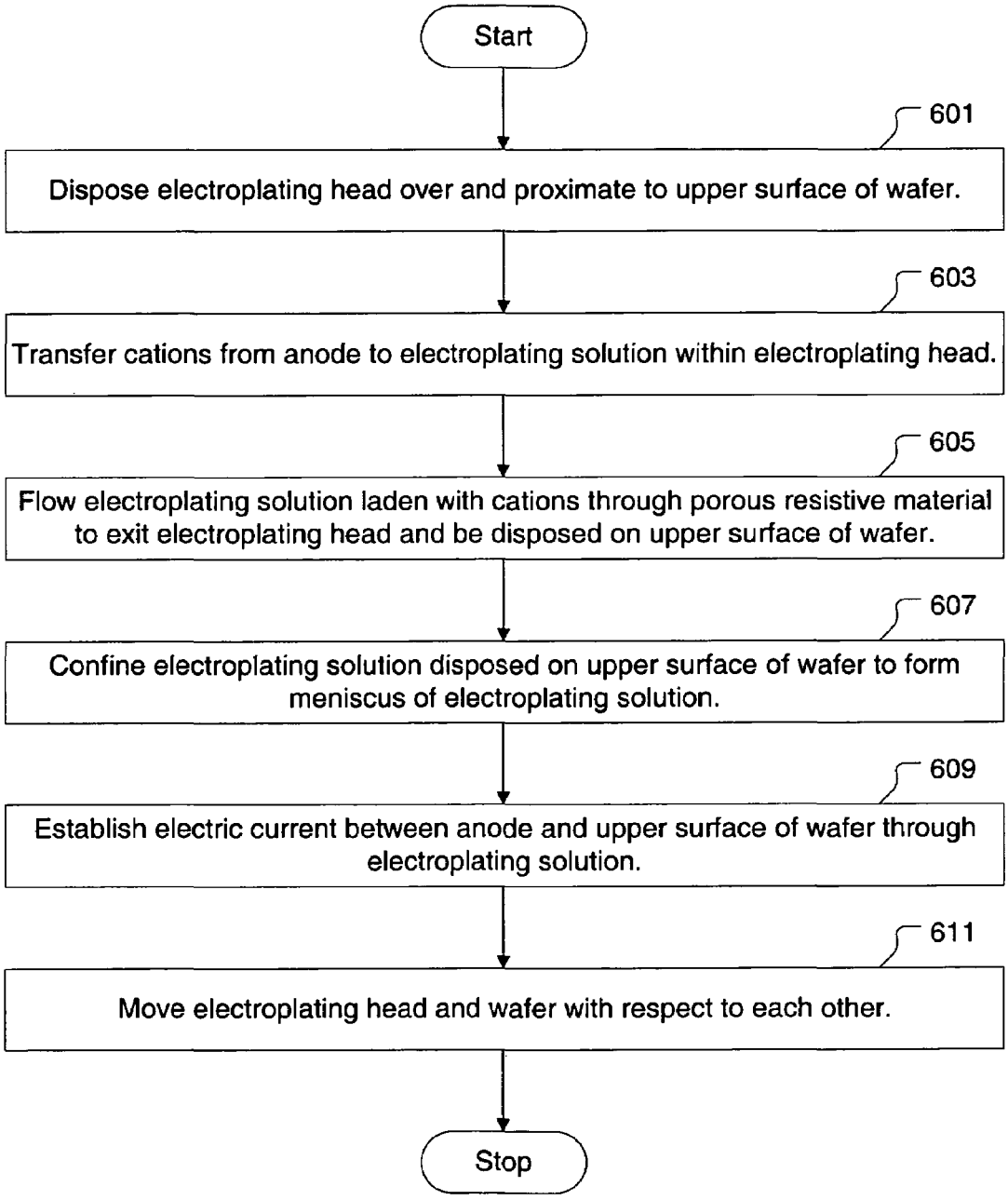
FIG. 6 is an illustration showing a flowchart of a method for operating an electroplating head, in accordance with one embodiment of the present invention.

FIG. 6 is an illustration showing a flowchart of a method for operating an electroplating head, in accordance with one embodiment of the present invention. The method includes an operation 601 for disposing the electroplating head over and proximate to an upper surface of a wafer. An operation 603 is then provided for transferring cations from an anode to an electroplating solution within the electroplating head. In one embodiment, the operation 603 is performed by flowing the electroplating solution over a membrane used to confine an analyte, wherein the membrane is capable of transmitting cations from the analyte to the electroplating solution. In an operation 605, the electroplating solution laden with cations is flowed through a porous resistive material to exit the electroplating head. Upon exiting the electroplating head, the cation laden electroplating solution is disposed on the upper surface of the wafer.

The method further includes an operation 607 for confining the electroplating solution disposed on the upper surface of the wafer to form a meniscus of electroplating solution. The meniscus of electroplating solution is maintained within a region between the porous resistive material and the upper surface of the wafer directly below the porous resistive material. In one embodiment, electroplating solution is removed from the meniscus in order to establish a flow of electroplating solution through the meniscus.

In an operation 609, an electric current is established between the anode and the upper surface of the wafer through the electroplating solution. The porous resistive material causes the electric current to be uniformly distributed across the upper surface of the wafer in contact with the meniscus of electroplating solution. The electric current causes the cations within the meniscus of electroplating solution to be attracted to and plated on the upper surface of the wafer. The method further includes an operation 611 in which the electroplating head and wafer are controlled to be moved with respect to each other. In one embodiment, the wafer is maintained in a fixed position and the electroplating head is moved over the wafer such that an entirety of the upper surface of the wafer is exposed to the meniscus of electroplating solution. In another embodiment, the electroplating head is maintained in a fixed position and the wafer is moved under the electroplating head such that an entirety of the upper surface of the wafer is exposed to the meniscus of electroplating solution.

In contrast to the present invention, conventional electroplating systems require systematic replenishment, or spiking, of the electroplating solution. The systematic replenishment of the electroplating solution requires sophisticated real-time chemical assay capability to determine whether the electroplating solution is within process control limits. Also, the convention electroplating system requires reclamation of the electroplating solution in order to control process costs.

In contrast to the conventional electroplating system, the electroplating head and associated meniscus of the present invention provides a confined electroplating reaction region that allows for implementation of a low-volume use-and-discard approach for managing chemistry of the electroplating solution, i.e., the separate analyte and catalyte. For example, with the present invention less than 50 milliliters of electroplating solution, i.e., catalyte, is required to plate a 200 millimeter diameter wafer. Therefore, the present invention allows for implementation of a cost effective use-and-discard method for electroplating solution management. Hence, expensive chemical metrology, spiking, recirculation, and reclamation capabilities are not required to maintain tight process control during the electroplating process performed using the electroplating system of the present invention.

Conventional electroplating systems that are configured to provide simultaneous full-wafer plating are unable to plate very resistive barrier films on the wafer surface without a having a low-resistance intermediate film previously applied to the wafer. For example, in the case of Cu plating over a very resistive barrier film, the conventional system requires a PVD Cu seed layer to be applied prior to the full-wafer electroplating process. Without this seed layer, a resistance drop across the wafer will induce a bipolar effect during the full-wafer plating. The bipolar effect results in de-plating and etching within a region adjacent to electrodes contacting the wafer. Use of the porous resistive material, as described with respect to the present invention, allows effects due to a resistivity of the upper surface of the wafer, particularly at the wafer edges, to be decoupled and minimized, thereby improving the uniformity of the subsequent plating process.

Also, the conventional full-wafer electroplating system requires uniformly distributed electrodes about the periphery of the wafer, wherein a resistance for each of the uniformly distributed electrodes is matched. In the conventional full-wafer electroplating system, the presence of an asymmetric contact resistance from one electrode to another will cause a non-uniform current distribution across the wafer, thus resulting in a non-uniform material deposition across the wafer. Use of the porous resistive material, as described with respect to the present invention, allows the current flux to be uniformly distributed across the wafer surface area being plated, regardless of the number of electrodes and contact resistance of the electrodes.

While this invention has been described in terms of several embodiments, it will be appreciated that those skilled in the art upon reading the preceding specifications and studying the drawings will realize various alterations, additions, permutations and equivalents thereof. Therefore, it is intended that the present invention includes all such alterations, additions, permutations, and equivalents as fall within the true spirit and scope of the invention.

What is claimed is:

1. An electroplating head, comprising:

a main chamber having a fluid entrance and a fluid exit, the main chamber being configured to contain a flow of electroplating solution from the fluid entrance to the fluid exit;

a membrane defined to form a portion of a sidewall of the main chamber;

an anode chamber defined opposite the membrane from the main chamber such that the membrane separates the anode chamber from the main chamber;

an anode disposed within the anode chamber, wherein the anode is electrically connected to a power supply, and wherein the anode is oriented in a substantially vertical manner within the anode chamber so as to be substantially parallel to the membrane and so as to enable natural circulation within the anode chamber; and a porous electrically resistive material disposed at the fluid exit, the flow of electroplating solution being required to traverse from the main chamber through the porous electrically resistive material, wherein the electroplating head is configured to be positioned above an upper surface of a semiconductor wafer to be electroplated such that the fluid exit faces downward toward the upper surface of the semiconductor wafer with the porous electrically resistive material positioned proximate to and parallel to the upper surface of the semiconductor wafer.

2. An electroplating head as recited in claim 1, wherein the membrane is defined to allow passage through the membrane of cations to be released from the anode.

3. An electroplating head as recited in claim 2, further comprising:

a second membrane defined to form a portion of a second sidewall of the main chamber;

a second anode chamber defined opposite the second membrane from the main chamber such that the second membrane separates the second anode chamber from the main chamber; and a second anode disposed within the second anode chamber, wherein the second anode is oriented in a substantially vertical manner within the second anode chamber so as to be substantially parallel to the second membrane and so as to enable natural circulation within the second anode chamber, wherein the second membrane is defined to allow passage through the second membrane of cations to be released from the second anode, and wherein the second anode is electrically connected to the power supply.

4. An electroplating head as recited in claim 1, wherein the fluid exit is defined to have a long dimension and a short dimension, the long dimension being at least equal to a diameter of a semiconductor wafer, the short dimension being less than the diameter of the semiconductor wafer, the porous electrically resistive material being defined to completely cover the fluid exit.

5. An electroplating head as recited in claim 1, wherein the porous electrically resistive material is positioned proximate to and parallel to the upper surface of the semiconductor wafer such that a meniscus of electroplating solution is formed between the porous electrically resistive material and the upper surface of the semiconductor wafer thereby causing an electric current to flow between the anode and the semiconductor wafer through the electroplating solution.

6. An electroplating head as recited in claim 5, wherein the upper surface of the semiconductor wafer in contact with the meniscus of electroplating solution serves as a cathode during electroplating of the semiconductor wafer.

7. An electroplating head as recited in claim 1, wherein the porous electrically resistive material is capable of uniformly distributing an electric current to be established between the anode and the upper surface of the semiconductor wafer by way of the electroplating solution having exited the main chamber through the porous electrically resistive material.

8. An electroplating head as recited in claim 1, wherein the porous electrically resistive material is a ceramic material having an average pore diameter within a range extending from about 30 micrometers to about 200 micrometers.

9. An apparatus for electroplating a semiconductor wafer, comprising:

a wafer support configured to hold a wafer;

an electroplating head configured to be disposed above an upper surface of the wafer to be held by the wafer support, the electroplating head having a processing area defined to be substantially parallel with and proximate to an upper surface of the wafer, the processing area being defined by a long dimension that is at least equal to a diameter of the wafer and a short dimension that is less than the diameter of the wafer, the processing area being further defined as an exterior surface area of a porous electrically resistive material facing downward from the electroplating head;

a first electrode disposed at a first location proximate to a first peripheral half of the wafer support, the first electrode being movably configured to electrically contact the wafer to be held by the wafer support; and a second electrode disposed at a second location proximate to a second peripheral half of the wafer support that is exclusive of the first peripheral half of the wafer support, the second electrode being movably configured to electrically contact the wafer to be held by the wafer support, wherein the electroplating head and the wafer support are configured to move with respect to one another in a direction extending between the first electrode and the second electrode so that the electroplating head can traverse above and over an entirety of the upper surface of the wafer when the wafer is held by the wafer support, wherein the electroplating head includes:

a main chamber having a fluid entrance and a fluid exit, the main chamber being configured to contain a flow of electroplating solution from the fluid entrance to the fluid exit, the porous electrically resistive material being disposed at the fluid exit such that the flow of electroplating solution is required to traverse through the porous electrically resistive material, and a membrane defined to form a portion of a sidewall of the main chamber, and an anode chamber defined opposite the membrane from the main chamber such that the membrane separates the anode chamber from the main chamber, and an anode disposed within the anode chamber, wherein the anode is electrically connected to a power supply, and wherein the anode is oriented in a substantially vertical manner within the anode chamber so as to be substantially parallel to the membrane and so as to enable natural circulation within the anode chamber.

10. An apparatus for electroplating a semiconductor wafer as recited in claim 9, wherein the membrane is defined to allow passage through the membrane of cations to be released from the anode.

11. An apparatus for electroplating a semiconductor wafer as recited in claim 9, wherein the proximity of the processing area of the electroplating head to the upper surface of the wafer is sufficiently close to allow a meniscus of electroplating solution to be formed between the processing area and a portion of the upper surface of the wafer directly below the processing area.

12. An apparatus for electroplating a semiconductor wafer as recited in claim 11, wherein contact between the processing area of the electroplating head and the meniscus allows an electric current to flow through the meniscus to either the first electrode or the second electrode having been moved to electrically contact the wafer.

13. An apparatus for electroplating a semiconductor wafer as recited in claim 12, wherein the porous electrically resistive material is capable of uniformly distributing the electric current.

14. An apparatus for electroplating a semiconductor wafer as recited in claim 9, wherein the porous electrically resistive material is a ceramic material having an average pore diameter within a range extending from about 30 micrometers to about 200 micrometers.

15. An apparatus for electroplating a semiconductor wafer as recited in claim 9, wherein the electroplating head is configured to remain in a fixed position and the wafer support is configured to move relative to the electroplating head.

16. An apparatus for electroplating a semiconductor wafer as recited in claim 9, wherein the wafer support is configured to remain in a fixed position and the electroplating head is configured to move relative to the wafer support.

* * * * *